US011534776B2

(12) United States Patent
Duffin et al.

(10) Patent No.: US 11,534,776 B2
(45) Date of Patent: Dec. 27, 2022

(54) SPRINKLER HEAD

(71) Applicants: Don Duffin, Paul, ID (US); Roger Duffin, Paul, ID (US)

(72) Inventors: Don Duffin, Paul, ID (US); Roger Duffin, Paul, ID (US)

(73) Assignee: XCAD Valve and Irrigation, Inc., Paul, ID (US)

( * ) Notice: Subject to any disclaimer, the term of this patent is extended or adjusted under 35 U.S.C. 154(b) by 0 days.

(21) Appl. No.: 16/182,480

(22) Filed: Nov. 6, 2018

(65) Prior Publication Data

US 2019/0336991 A1 Nov. 7, 2019

Related U.S. Application Data

(60) Provisional application No. 62/581,904, filed on Nov. 6, 2017.

(51) Int. Cl.
*B05B 3/00* (2006.01)

(52) U.S. Cl.
CPC ..... *B05B 3/008* (2013.01)

(58) Field of Classification Search
CPC .. B05B 3/02; B05B 3/008; B05B 3/04; B05B 3/0409; B05B 3/0463; B05B 3/0472; B05B 3/0486; B05B 3/0421; B05B 3/0445; B05B 3/0427; B05B 3/006; Y10S 239/11
USPC ..... 239/222.17
See application file for complete search history.

(56) References Cited

U.S. PATENT DOCUMENTS

| | | | | |
|---|---|---|---|---|
| 5,381,960 | A * | 1/1995 | Sullivan | B05B 3/0486 239/734 |
| 7,942,345 | B2 * | 5/2011 | Sesser | B05B 3/008 239/222.21 |
| 8,028,932 | B2 * | 10/2011 | Sesser | B05B 3/0486 239/222.11 |
| 9,457,363 | B2 * | 10/2016 | Duffin | B05B 3/008 |
| 2010/0252654 | A1 * | 10/2010 | Sesser | B05B 3/008 239/222.17 |

* cited by examiner

*Primary Examiner* — Christopher R Dandridge
(74) *Attorney, Agent, or Firm* — Shaver & Swanson, LLP; Scott D. Swanson

(57) ABSTRACT

What is disclosed is an improved sprinkler utilizing a nutation mechanism. The sprinkler utilizes a race having an upper limit and lower limit. The tire is connected to the distributor. Water sprays on the distributor causing the nutation of the device in which the tire moves between the upper race and lower race limits. The sprinkler includes a separate starting mechanism on which a starting bump is positioned on a distributor support.

3 Claims, 8 Drawing Sheets

SPRINKLER HEAD

TECHNICAL FIELD

The herein disclosed and claimed inventive concepts generally relates to a sprinkler head, and more particularly to a nutation sprinkler head for randomizing liquid distribution.

SUMMARY OF INVENTION

Figure 1:
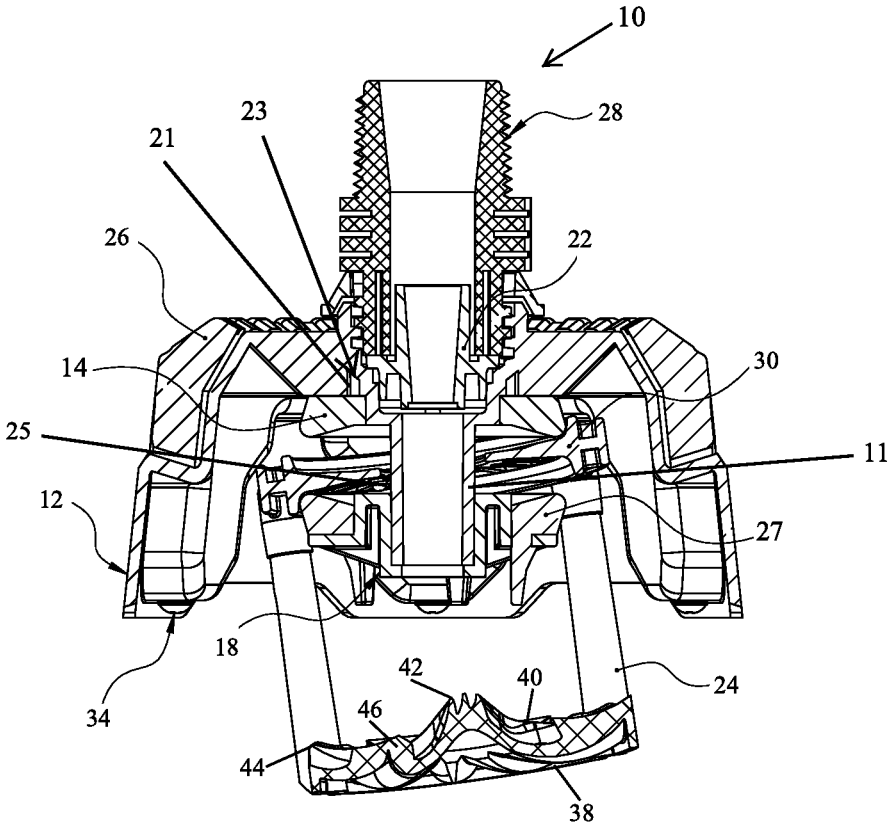
FIG. 1 is an illustration of a front cutaway view of a first embodiment of a sprinkler head.

The purpose of the Summary of Disclosure is to enable the public, and especially the scientists, engineers, and practitioners in the art who are not familiar with patent or legal terms or phraseology, to determine quickly from a cursory inspection, the nature and essence of the technical disclosure of the application. The Summary of the Invention is neither intended to define the invention of the application, which is measured by the claims, nor is it intended to be limiting as to the scope of the invention in any way.

A liquid, preferably water, distributing sprinkler head that has a housing with an attached nozzle. The nozzle is connected to an adapter that will be attached to an incoming liquid supply. The sprinkler comprises a tire carrier assembly comprising of a tire and a lower tire.

The sprinkler comprises a distributor with the distributor hanging loosely from an arm holder. The distributor has a lower plate that is held in a spaced apart relationship by one or more arms connected to a swashing ring. The lower plate has a lower plate first side having a generally peaked surface profile with an upturned edge at the periphery of the plate. The peaked surface incised by spirally radiating grooves with a peak on the lower plate first side centrally positioned and having a beveled top surface.

The distributor is configured to hang freely from the swashing ring when distributor is idle with the bevel on the lower plate configured to be deflected by an initial jet of liquid from an incoming liquid supply that travels through the sprinkler. The distributor begins a nutation motion after the initial deflection with the nutation motion maintained by the force of liquid on the spirally radiating grooves.

The arm holder comprises a starting bump, wherein the swashing ring rests on the starting bump when sprinkler is idle causing the distributor to tilt allowing for initialization of nutation motion.

The tire and lower tire of the sprinkler encapsulate the swashing ring which provides sufficient friction between the swashing ring and the tire and prevents slipping.

The sprinkler further comprises additional weight in said sprinkler body. Still other features and advantages of the claimed invention will become readily apparent to those skilled in this art from the preceding detailed description of preferred embodiments of the invention, simply by way of illustration of the best mode contemplated by carrying out my invention. As will be realized, the invention is capable of modification in various obvious respects all without departing from the invention. Accordingly, the description of the preferred embodiments are to be regarded as illustrative in nature, and not as restrictive in nature.

DETAILED DESCRIPTION OF THE EXEMPLARY EMBODIMENTS

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

Certain preferred embodiments of the disclosed technology are shown in FIGS. 1 through 8.

FIG. 1 is a front view of the cutaway section of the liquid sprinkler 10. In a preferred embodiment the liquid sprinkler 10 is connected to a pipe or another fluid delivery mechanism. Shown is the housing 12 which encapsulates the inner workings of the liquid sprinkler 10. The housing has a tube that haThe swashing ring 30 spoils the liquid in a spinning motion that wobbles and nutates as the liquid hits the distributor 24. The swashing ring 30 helps the initial facilitation of the nutation process. The swashing ring 30 is connected to the top of the distributor 24.

In a preferred embodiment, the distributor 24 has arms that extend down from the swashing ring 30. When liquid leaves the nozzle 22, it strikes the distributor 24 which causes liquid to be distributed in a spoiling motion. In other embodiments, the sprinkler can have a lower tire 16 as well an original tire. The tire 14 comprises of a polyurethane material; however, the tire 14 and the lower tire 16 can be different types of elastomers. The tire 14 has rigid structure inside of the elastomeric which makes it compact.

In a preferred embodiment, the motion of the distributor 24 is nutation which is a combination of spinning and rolling.

In a preferred embodiment, the sprinkler 10 has a nozzle 22 which delivers the liquid through the sprinkler 10. Liquid is delivered to the nozzle 22 from the adapter 28 which is connected to a pipe or hose that provides an incoming source of liquid.

In a preferred embodiment, the tire carrier assembly 18 is in place to hold the lower tire 16. Shown is a coupling element 34 which secures the housing 12. Secured to the housing 12, is the weight 26. In a preferred embodiment, the material of the weight 26 is zinc, however, it a can be any number of materials in other embodiments. The weight 26 allows the sprinkler 10 to hang from a hose in a stabilized manner, protecting the sprinkler 10 from manipulation by wind.

In FIG. 1 the arm holder 19 forms a fluid distribution tube that extends from the body 12. The upper tire 14 is positioned around the arm holder 19 and attached to the body via a series of tabs 21 on the upper tire. The tabs connect into openings 23 formed in the sprinkler body to hold the upper tire in place. The fluid delivery tube extends downward and is connected to the lower tire carrier 18. The lower tire 27 attaches to the lower tire carrier 18 via a series of tabs 29 positioned on the lower tire 27 that connect via a series of openings in the lower tire carrier 18. Together the lower tire 27 and lower tire carrier 18 are referred to collectively as the lower tire assembly. The arm holder 20 comprises of a starting bump 25 positioned on an under surface of the swashing ring 30. When the sprinkler 10 is not in use, the distributor 24 hangs loosely from the lower tire assembly. The starting bump 25 allows for the initiation of the nutation process by forcing a tilted position of the distributor 24 so when liquid initially strikes the distributor 24 it will begin the nutation process. When the distributor 24 hangs loosely from the lower tire carrier and lower tire, it teeters on the starting bump 25 causing the distributor 24 to be unstable when liquid strikes, initiating the nutation of the sprinkler. In operation the swashing plate nutates between the upper tire and the lower tire, with the upper tire serving as an upper limit of the nutating motion of the swashing plate.

The distributor has a swashing ring 30 separated from a lower plate by one or more cage arms 24. The embodiments depicted in FIGS. 1-8 utilize three cage arms, although fewer or more cage arms may be utilized.

Figure 2:
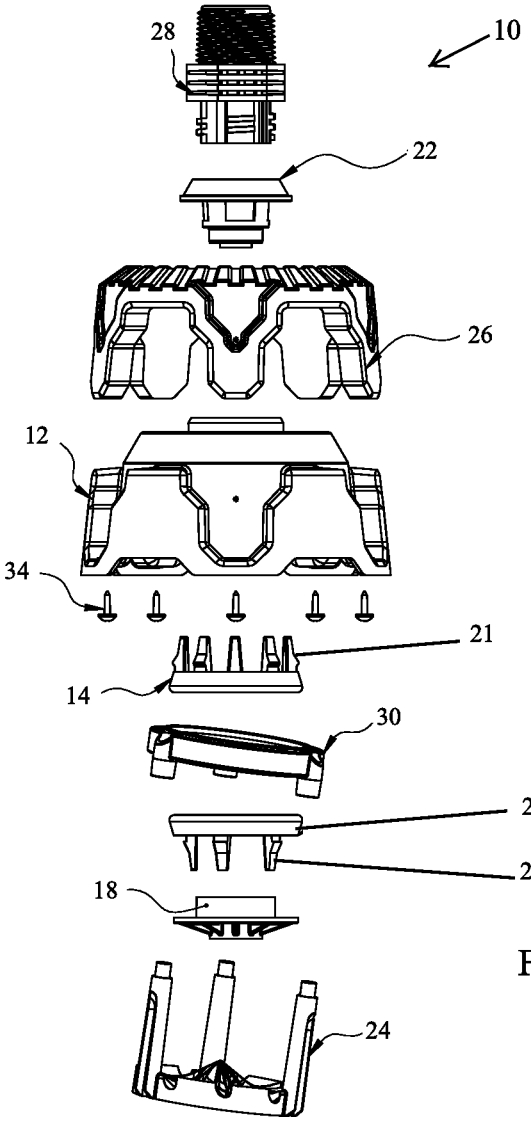
FIG. 2 is an illustration of a front exploded view of a first embodiment of a sprinkler head.

FIG. 2 is a front exploded view of the sprinkler head 10. In a preferred embodiment, the adapter 28 connects to the nozzle 22. The weight 26 is secured to the housing 12 and coupled together using the coupling element 34. The upper tire 14 is adjacent to the swashing ring 30. Also shown is the lower tire carrier 18, the lower tire 27 that attaches to the lower tire carrier and the distributor 24.

Figure 3:
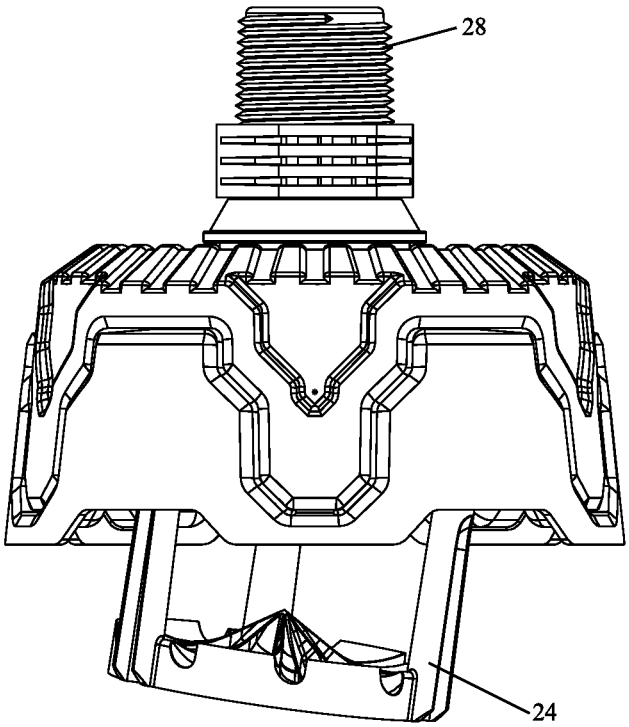
FIG. 3 is a front view of a first embodiment of a sprinkler head.

FIG. 3 is a front view of the assembled sprinkler head 10. In a preferred embodiment, the distributor 24 hangs freely from the housing when in the off position (in which fluid is not being sprayed onto the distributor causing nutation of the distributor). The distributor 10 comprises of a peaked surface that distributes liquid evenly as it strikes the distributor 10. The adapter 28 connects the sprinkler 10 to an external liquid source.

Figure 4:
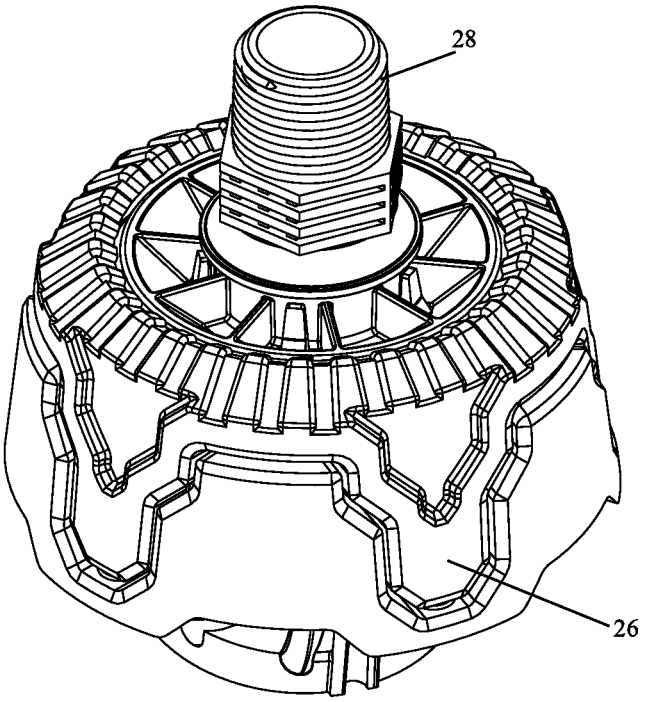
FIG. 4 is an isometric view of a first embodiment of a sprinkler head.

FIG. 4 is an isometric view of an alternate embodiment of a sprinkler head 10. The illustration depicts a sprinkler head having an adapter 28 for connection to an irrigation system. The adapter attaches to a weight plate that attaches to a housing 26. In a preferred embodiment, the weight 26 stabilizes the sprinkler when it is in operation as well as protects the sprinkler from external elements.

Figure 5:
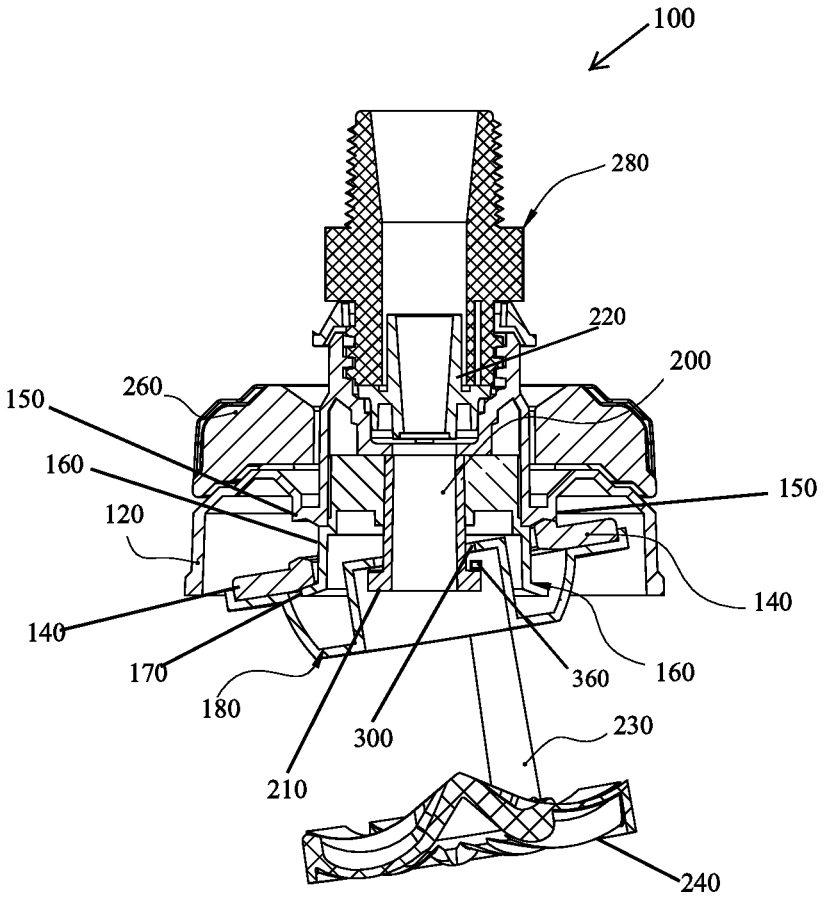
FIG. 5 is a front cutaway view of a second embodiment of a sprinkler head.

FIG. 5 is a front cutaway view of an alternate embodiment of a sprinkler head 100 with arm holder 200. The sprinkler can be constructed with one arm 240 or multiple arms. In a preferred embodiment, the liquid flows through an adapter 280, a nozzle 220, and through the arm holder 200 to the distributor 240. The sprinkler 100 utilizes a weight 260, fastened to a housing 120 to provide weight to stabilized the sprinkler and to protect the sprinkler. When the sprinkler is not in operation, the distributor hangs from the arm holder 200 at an off center position due to starting bump 360 positioned on the ledge of the arm holder 200. There can be one or more starting bumps. In operation, the tire 140 moves (nutates) in response liquid being sprayed on the distributor. The nutation moves the tire 140 between the upper limit 150 of the race 160 and the lower limit 170 of the race such that an upper side of the tire contacts the upper race limit 150 and a lower side of the tire contacts the lower race limit 160. The tire 140 is attached to the tire carrier so as to extend radially inward from the tire carrier to contact the race that is formed at a radially inward location from the tire. The tire carrier assembly 180 which includes a upper projection 300 (alternatively called a support arm rest) that rests on the one or more starting bump when the sprinkler is not in operation. When in operation the upper projection of the tire carrier assembly does not contact the starting bumps due to the nutation action of the tire within the race. In a preferred embodiment the race is constructed of a rigid material whereas the tire is a material of a less rigid nature, such as a rubber material.

Figure 6:
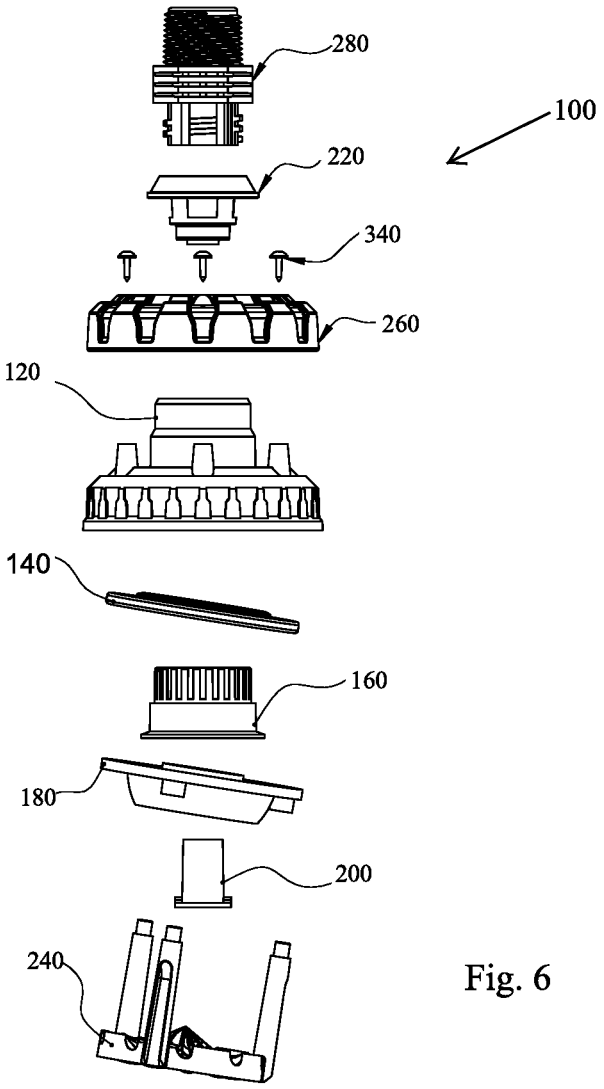
FIG. 6 is a front exploded view of a second embodiment of a sprinkler head.

FIG. 6 is an exploded view of the sprinkler head 100 with arm holder 200. In a preferred embodiment, the sprinkler 100 comprises an adapter 280 joined to a nozzle 220. The nozzle sits in the housing 120 which is coupled to a weight 260 using a coupling element 340. The distributor 240 hangs from an arm holder 200. The tire 140 is joined to the at tire carrier assembly 180. FIG. 6 illustrates that the race is formed by the race and lower race limit being connectable to the body with the upper race limit (not illustrated in FIG. 6) being formed integral to the body.

Figure 7:
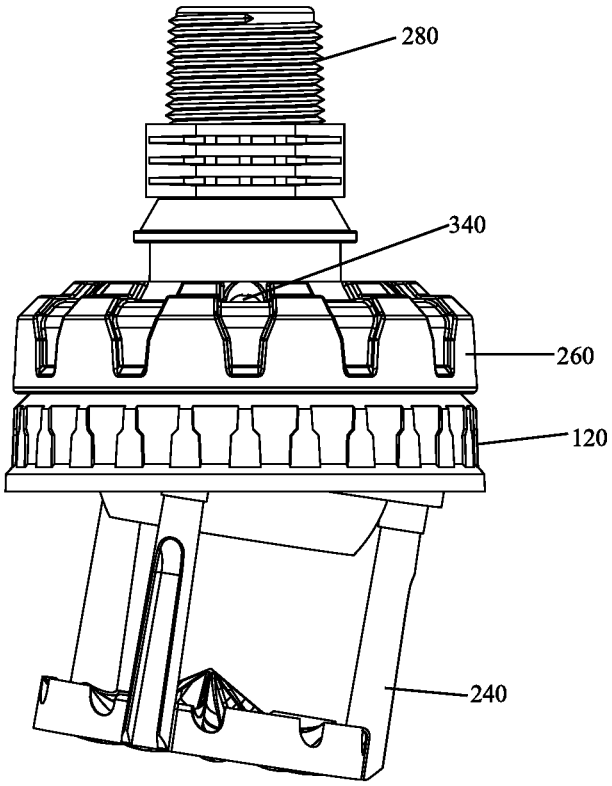
FIG. 7 is a front view of a second embodiment of a sprinkler head.

FIG. 7 is a front view of the sprinkler head 100 with arm holder 200. In a preferred embodiment, the adapter 280 connects the sprinkler to an external liquid source. The weight 260 is coupled to the housing 120 using the coupling element 340. The distributor 240 hangs loosely from the arm holder 200 when the sprinkler is not in use.

Figure 8:
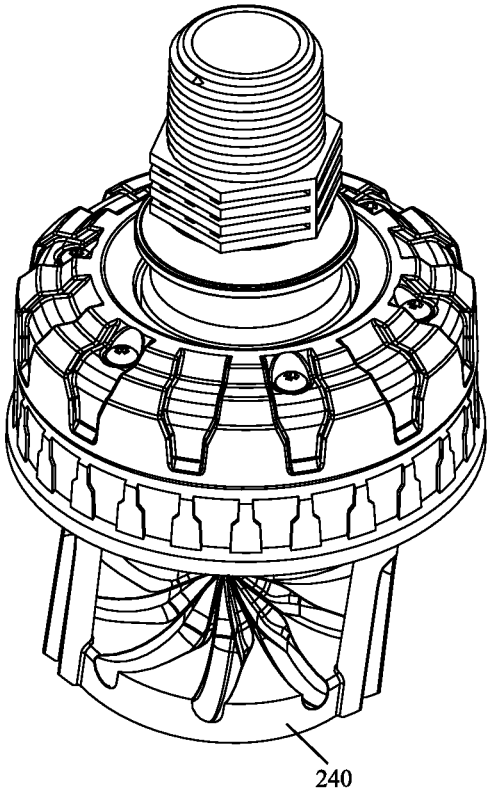
FIG. 8 is an isometric view of a second embodiment of a sprinkler head.

FIG. 8 is a sprinkler head 100 with arm holder 200 Isometric view. In a preferred embodiment, the adapter 280 connects the sprinkler to an external liquid source. The weight 260 is coupled to the housing 120 using the coupling element 340.

We claim:

1. A liquid distributing sprinkler head, comprising, a housing, with an attached nozzle, said nozzle connected to an adapter to be attached to an incoming liquid supply;

an arm holder extending from said housing, said arm holder comprising a flange having a starting bump;

a distributor comprising a tire carrier assembly comprising of a tire and a tire carrier, said tire carrier comprising a first annular ring said tire carrier comprising a second annular ring radially outward from said first annular ring and positioned in a spaced apart relation to said first annular ring, wherein said second annular ring defines a tire mounting flange, said tire being connected to said tire carrier at said tire mounting flange with said tire extending radially inward from said first annular ring toward said second annular ring, said distributor comprising a lower plate being held apart in a spaced apart relationship from said tire carrier assembly by one or more cage arms, with said distributor being freely attached to said arm holder such that said first annular ring is positioned around said arm holder such that said tire carrier is configured to hang by said first annular ring in a tilted orientation from said flange of said arm holder and said starting bump when said sprinkler is in an off position such that said first annular ring is in a tilted position;

said lower plate having a lower plate first side having a generally peaked surface profile with an upturned edge at the periphery of the plate, said surface incised by spirally radiating grooves with a peak on said lower plate first side centrally positioned and having a beveled top surface;

wherein said distributor is configured such that when said distributor is in said off position said beveled top surface on said lower plate is configured to be deflected by an initial jet of liquid from the incoming liquid supply that travels through said sprinkler, and for the distributor to begin a nutation motion after said initial deflection with said nutation motion maintained by a force of the liquid from the incoming liquid supply on said spirally radiating grooves; and wherein said body comprising a race having an upper race limit and a lower race limit, wherein said race is positioned at a radially inward position from said tire so as to be positioned between said first annular ring and said second annular ring such that said tire extends radially inward from said second annular ring to said race such that said tire is configured to nutate between said upper race limit and said lower race limit when said distributor is in said nutating motion.

2. The sprinkler head of claim 1 which further comprises a weight attached to said sprinkler body.

3. The sprinkler head of claim 1, wherein said tire is removably attached to said second annular ring.

* * * * *